United States Patent [19]

Scholten

[11] 4,207,859

[45] Jun. 17, 1980

[54] ARCHERY BOW

[76] Inventor: Gerard J. Scholten, Heemskerklaan 4, Son & Breugel, Netherlands

[21] Appl. No.: 916,484

[22] Filed: Jun. 19, 1978

[30] Foreign Application Priority Data

Jul. 1, 1977 [NL] Netherlands ..... 7707312

[51] Int. Cl.[2] ..... F41B 5/00

[52] U.S. Cl. ..... 124/24 R; 273/DIG. 7

[58] Field of Search ..... 124/24 R, 23 R, 41 A, 124/88, 90; 273/DIG. 7

[56] References Cited

U.S. PATENT DOCUMENTS

| | | | |
|---|---|---|---|
| 3,766,904 | 10/1973 | Izuta | 124/24 R |
| 3,981,290 | 9/1976 | Islas | 124/24 R |
| 4,041,927 | 8/1977 | Van House | 124/24 R X |

*Primary Examiner*—William R. Browne

*Attorney, Agent, or Firm*—Robert S. Smith

[57] ABSTRACT

An archery bow has a handle section to which a bow limb, which is flexible over at least part of its length, is connected at each end. A bowstring is tensioned between the free ends of the two bow limbs. The handle section is extended by means of rigid axial extensions. Each of the bow limbs includes a comparatively flexible portion and has a first end hingedly connected to one end of the handle section. The second end of each flexible portion is hingedly connected to the free end of the associated extension. Each bow limb further includes a comparatively rigid portion which extends between the second end of said flexible portion and the free end of the bow limb, the arrangement being such that the comparatively flexible portion is subjected substantially to bending by buckling only.

7 Claims, 10 Drawing Figures

Fig. 1
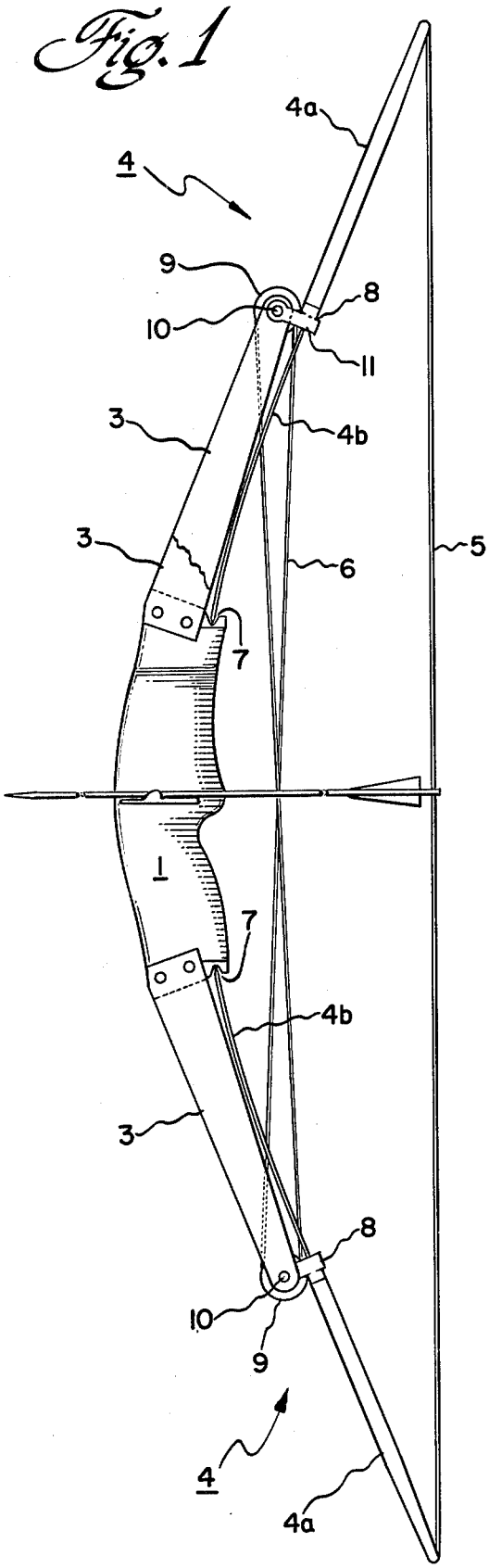
Fig. 2
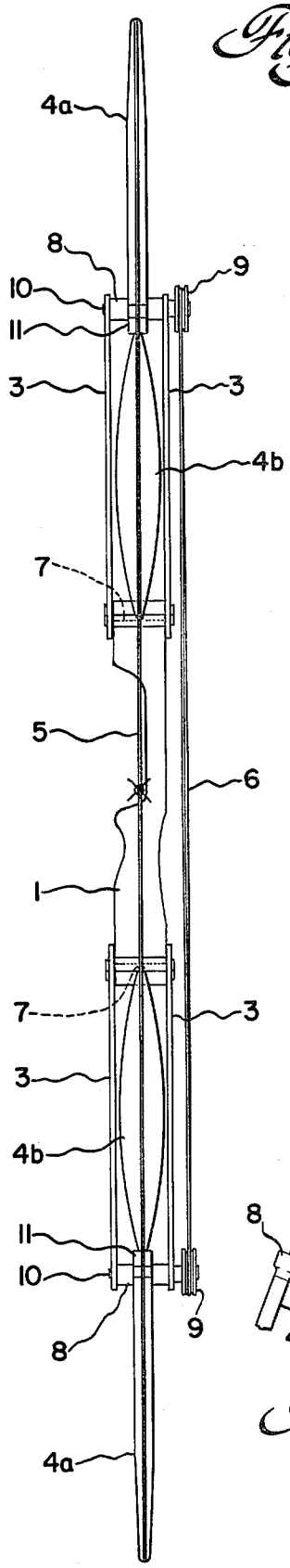
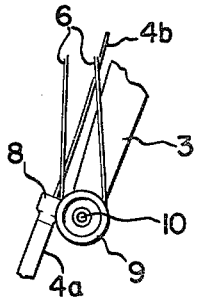
Fig. 10

ARCHERY BOW

BACKGROUND OF THE INVENTION

The invention relates to an archery bows. A bowstring is tensioned between the free ends of the two bow limbs. The bowstring of known archery bows is tensioned between two bow limbs which act as leaf springs and which are made of, for example, wood, glass-fibre reinforced wood, steel or another suitable elastic material.

During the drawing of a bow, the force gradually increases, so that maximum force must be exerted in the fully-drawn bow position. In other words, the so-termed draw characteristic which represents the relationship between draw force and draw length is a continuously rising function. The larger the distance to be covered by an arrow, the larger the arrow velocity should be and, therefore, the larger the maximum force to be exerted should be.

It is an object of the invention to provide an archery bow which requires a substantially smaller force to be exerted in the fully-drawn bow position in order to achieve a given arrow velocity, so that a larger distance can be covered for a given effort.

SUMMARY OF THE INVENTION

To this end, the archery bow in accordance with the invention is characterized in that the two ends of the handle section are extended by means of rigid extensions, each of the bow limbs consisting on the one hand of a comparatively flexible portion, a first end of which is hingedly connected to one end of the handle section while its second end is hingedly connected to the free end of the associated extension. Each bow limb further includes a comparatively rigid portion which extends between the second end of said flexible portion and the free end of the bow limb, the arrangement being such that the comparatively flexible portion is subjected substantially to bending by buckling only.

BRIEF DESCRIPTION OF THE DRAWING

The invention will be described in detail hereinafter with reference to the accompanying drawings which also show some embodiments of bow limbs of an archery bow in accordance with the invention.

FIG. 1 and FIG. 2 are respectively a diagrammatic side elevation and rear view of an embodiment of an archery bow in accordance with the invention.

FIG. 10 is another diagrammatic view of the embodiment of FIGS. 1 and 2 showing the location of the pulleys in greater detail.

DESCRIPTION OF THE PREFERRED EMBODIMENT

Figure 3:
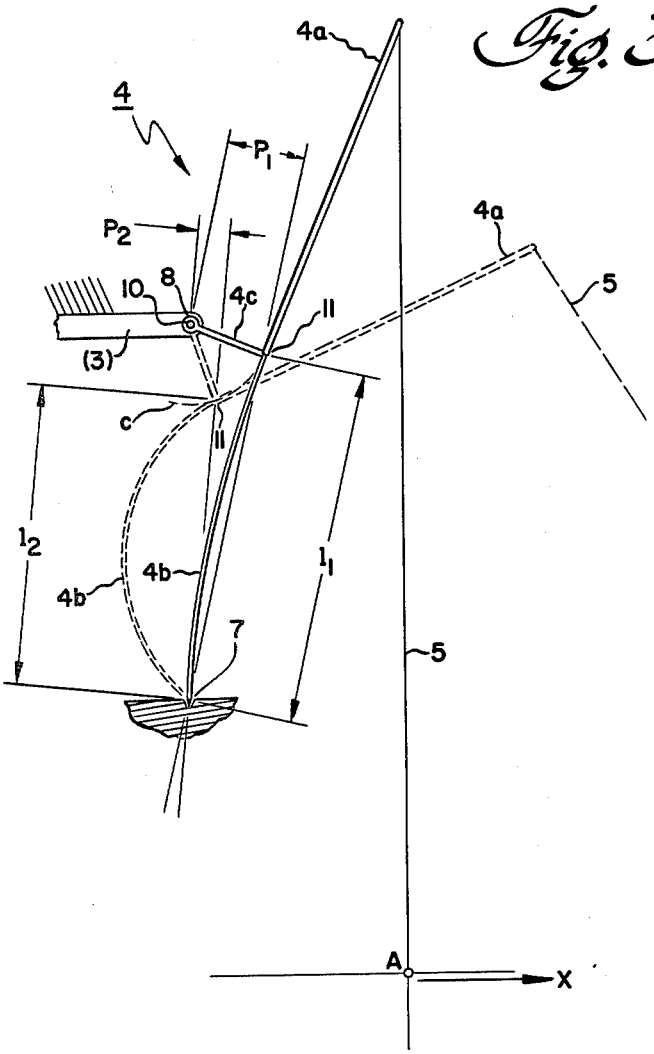
FIG. 3 is a diagrammatic view showing the drawing of the archery bow.

The construction of an embodiment of an archery bow in accordance with the invention will be described in detail hereinafter with reference to FIGS. 1, 2, and 10. The archery bow shown in FIG. 1 consists of a handle section 1, the ends of which are extended by rigid extensions 3, each of which consists of two parallel supporting plates. The bow limbs 4, consisting of a comparatively rigid portion **4*a* and a comparatively flexible portion 4*b*, are hingedly connected to the free ends of the supporting plates 3 by means of a hinge construction 8 at the area of the connection 11 of the portions 4*a* and 4*b*. The lower end of the bow limb 4 is hingedly supported in a knife edge bearing 7 at one end of the handle section 1. The hinge constructions 8 includes pulleys 9 which are interconnected by means of an endless cable 6 which is guided around the pulleys and which is crossed at the area of the handle section 1. Furthermore, protrusions or notches (not shown) for securing a single bowstring 5 are provided on the free ends of the bow limbs 4. The connection 11 is also constructed as a knife edge bearing in the embodiment shown in FIG. 1. The knife edge bearings 7 and 11** may alternatively be constructed as resilent connections.

Figure 4:
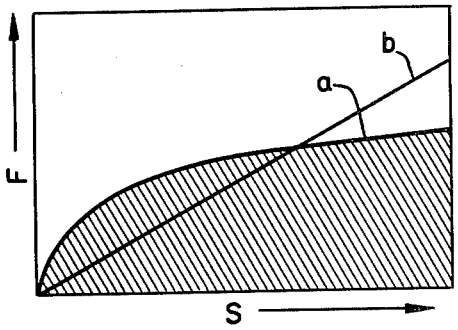
FIG. 4 is a diagrammatic view illustrating favorable draw characteristic, and also a draw characteristic of a prior art bow.
Figure 5:
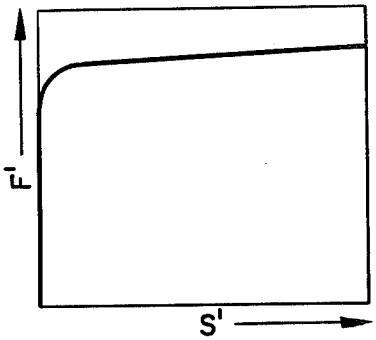
FIG. 5 shows diagramatically a spring characteristic of a part of the bow limb.
Figure 6:
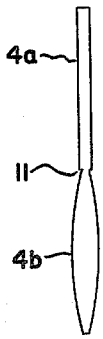
FIGS. 6 and 7 diagrammatically show respectively a first embodiment of a bow limb in a front view and a side elevation.
Figure 7:
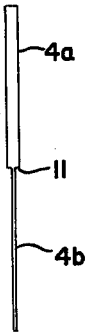
Figure 8:
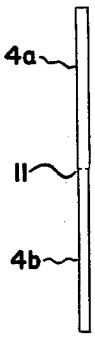
FIGS. 8 and 9 diagrammatically show respectively a second embodiment of a bow limb in a front view and a side elevation.
Figure 9:
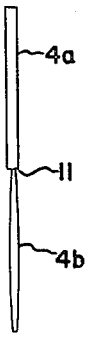

The drawing of the bow will be described in detail hereinafter with reference to FIG. 3, which diagrammatically shows the most essential part, i.e. the bow limb 4 in its suspension. During the drawing of the bow, the center of the bowstring 5, i.e. the point A, will be displaced in the direction of the arrow X. This will cause the portion **4*a* of the bow limb 4 and the portion 4*c*, rigidly connected to the bow limb 4, to rotate around the hinge axis 10. The connection 11 between the portions 4*a* and 4*b* will move along a portion of an arc of a circle c. As a result, the distance $l_1$ between the connection 11 and the knife edge bearing 7 is reduced to, for example, $l_2$. Consequently, the portion 4*b* of the bow limb 4, constructed as a leaf spring, will be bent by buckling. Therefore, this leaf spring will store potential energy which can be converted, via the bow limb portion 4*a* and the bow spring 5, into kinetic energy for the arrow. Utilizing a suitable construction, it can be achieved that the pressure line $P_1$, extending through the connection 11 and the knife edge bearing 7, is moved towards the hinge axis 10, for example to the position indicated as pressure line $P_2$. Due to inter alia the favorable spring characteristic of a buckling/bending spring, the torque required for rotating the bow arm portion 4*a* against the buckling force delivered by the leaf spring 4*b* may decrease after a given angular rotation of the portion 4*a*. The very favorable drawing characteristic as denoted by the line a in FIG. 4 can thus be obtained. In this Figure, the letter S denotes the drawing distance and the letter F denotes the associated drawing force. The shaded area below the line a in FIG. 4 represents the potential energy present in the bow at full draw. When this area is compared with the area below the line b, being the draw characteristic of a conventional bow, it will be obvious that a substantially lower maximum draw force will be required for obtaining the same quantity of potential energy. The comparatively flexible portion 4*b* of the bow limb 4 is of major importance for obtaining such a favorable draw characteristic. This is because a buckling/bending spring has a spring characteristic as shown in FIG. 5**. Therein, S′ represents the compression distance and F′ represents the compression force. This means that a large force is required for initiating the bending by buckling. Further buckling will only require a comparatively small increase of the force.

In order to enable the available potential energy to be converted as efficiently as possible into kinetic energy for the arrow, a high bow efficiency is required; in other words, the mass inertia losses should be minimum. For the bow limb portions 4*a*, this can be achieved by a rigid and light construction and by using a favorable material, for example, balsa wood or hard plastic foam reinforced with, for example, carbon fibres or boron filaments or other suitable materials having a high modulus of elasticity, high strength and low specific weight. For the bow limb portions 4*b*, this can be achieved by choosing a material having favorable elastic properties, for example, high-quality spring steel or another suitable material, and by using a buckling/bending spring which is shaped so that a maximum amount of available potential energy is obtained for a given spring mass. The latter can be achieved by shaping the cross-section in the longitudinal direction so that during buckling the leaf spring is always deformed so as to assume the shape of an arc of a circle as closely as possible. This can be realized by imparting a predetermined oval shape to the leaf spring in its width or thickness direction as shown in the FIGS. 6, 7, 8, and 9, respectively. Thus, the cross-section is maximum in the middle and gradually decreases towards the ends. The function of the pulleys 9 and the cable 6 will now be described. Because the two bow limbs exhibit little stability with respect to each other after a given instant—as will be obvious from the line a in FIG. 4—the angular rotations of the two bow limbs should be coupled to each other to some extent. This can be realized by means of the pulleys 9, secured to the limb 4 and rotatable around the rotary shaft 10, and the endless cable 6 which is cross-wise guided around these pulleys. The bow limb portions 4*a* will thus perform a substantially equal but opposite rotation.

Having thus described my invention I claim:

1. An archery bow which comprises: an elongated handle section, first and second bow limbs, each of which includes a first axial portion which is flexible and a second end abutting axial portion which is more rigid than said first axial portion, said first and second bow limbs being connected respectively at each end of said elongated handles section, a bow string tensioned between the free ends of said first and second bow limbs, rigid extensions extending from each end of said handle section, a first end of each of said first axial portions being hingedly connected to one end of said handle section and a section end of each bow limb being respectively hingedly connected to the free end of said extensions, said second axial portions extending respectively from said second ends of said first axial portions and each said second axial portion having a free end which constitutes the free end of said bow limb, said first axial portions being subjected substantially to bending by buckling only.

2. An archery bow as claimed in claim 1, wherein said first end of each of said first axial portions hingedly connected to one end of said handle section has a hinged connector which is formed by a rigid coupling piece which is hingedly connected to one of said rigid extensions.

3. An archery bow as claimed in claim 2 wherein said first end of each of said first axial portions which is hingedly connected to one end of said handle section is hingedly connected by cooperating knife edge and groove surfaces.

4. An archery bow as claimed in claim 3 wherein each of said second ends of said first axial sections which are hingedly connected to the free ends of said extensions is hingedly connected by cooperating knife edge and groove surfaces.

5. An archery bow as claimed in claim 1 wherein said first axial portion of each of said bow limbs has a cross-section which is maximum near the middle thereof and which gradually decreases toward the ends.

6. An archery bow as claimed in claim 1 further including means to couple movements of said bow limbs to each other which comprises two pulleys and a cable, said cable being guided around said two pulleys which are respectively disposed in coaxial relation to the axis of the hinge connections between the free ends of said extensions and said first axial portions, said cable being crossed at the area of said handle section.

7. An archery bow as claimed in claim 1 wherein said second coaxial portions are made of a synthetic material reinforced with carbon fibers or boron filaments.

* * * * *